US005696833A

United States Patent [19]

Matzen et al.

[11] Patent Number: 5,696,833

[45] Date of Patent: Dec. 9, 1997

[54] HEARING AID HAVING EXTERNALLY CONTROLLED AMPLIFIER GAIN AND METHOD OF USING SAME

[75] Inventors: Norman P. Matzen, Campbell, Calif.; Mead Killion, Elk Grove Village, Ill.

[73] Assignee: Etymotic Research, Inc., Elk Grove Village, Ill.

[21] Appl. No.: 407,465

[22] Filed: Mar. 20, 1995

[51] Int. Cl.[6] ..... H04R 29/00

[52] U.S. Cl. ..... 381/60; 381/58; 381/68.4; 330/138

[58] Field of Search ..... 381/60, 58, 68, 381/68.4, 120; 73/585; 330/52, 279, 136, 138, 280

[56] References Cited

U.S. PATENT DOCUMENTS 4,061,041 12/1977 Fletcher et al. ..... 330/52
4,170,720 10/1979 Killion .
4,821,329 4/1989 Straub ..... 381/107

*Primary Examiner*—Curtis Kuntz
*Assistant Examiner*—Vivian Chang
*Attorney, Agent, or Firm*—McAndrews, Held & Malloy, Ltd.

[57] ABSTRACT

An electronic device is set forth that allows external control of a controllable electronic function of the device. The device includes a function circuit for implementing an electronic function in response to a signal at a function control signal input. The function circuit receives DC power from a power supply that is connected between two battery terminals. The DC power from the power supply circuit is supplied at a predetermined DC voltage level. A control circuit is included in the device and is responsive to a signal superimposed on the predetermined DC voltage level of the power supply at the two battery terminals for generating a function control signal to the function control signal input of the function circuit. In accordance with one embodiment of the present invention, the invention is implemented in the context of a hearing aid.

25 Claims, 4 Drawing Sheets

HEARING AID HAVING EXTERNALLY CONTROLLED AMPLIFIER GAIN AND METHOD OF USING SAME

TECHNICAL FIELD

The present invention relates to an electronic device having an externally controlled function. More particularly, the present invention relates to a hearing aid which includes a gain control circuit that is responsive to a control signal that is superimposed on the battery power supply of the hearing aid for controlling the gain of the hearing aid amplifier.

BACKGROUND

A problem encountered in assembling high-gain hearing aids is that of "internal feedback." This is typically caused when the receiver or receiver tube touches the case after the assembly is closed, causing the case to vibrate and create sound much like a miniature loudspeaker vibrating. This sound is picked up by the microphone and amplified. If the gain is sufficiently high, the amplified sound creates even greater vibration, which in turn creates greater sound. The end result of this process is a whistle or squeal due to this internal feedback.

An attempt to eliminate this feedback is made during assembly of the hearing aid by an assembler. During assembly, the assembler turns the volume control of the hearing aid amplifier to full on gain and listens for feedback as the assembly is assembled within a housing ("cased"). The assembler readjusts the hearing aid receiver or receiver tube placement as required.

A special problem is encountered in assembling wide dynamic range compression circuits such as the K-AMP circuit available from Etymotic Research, Inc., of Illinois. Such a compression amplifier circuit is set forth in U.S. Pat. No. 4,170,720, to Killion, and U.S. Pat. No. 5,131,046, to Killion, the teachings of which are hereby incorporated by reference. When such a compression amplifier is utilized in the hearing aid, the background noise in the assembly area often creates a sound pressure level that is much higher than the lower threshold of compression (point B on FIG. 4 in the abovementioned patent), so that the compression control circuit, sensing this higher SPL, reduces the gain accordingly. The assembler may hear no feedback on assembly, even with careful listening. Nevertheless, the hearing aid may squeal at final test where it is tested in a quiet chamber thus resulting in rejection of the hearing aid.

One possible solution to this problem was suggested in Etymotic Research Application Note #5. The suggested solution included the soldering of a fine wire from the gain control point of the compression amplifier (pad 84 in the foregoing '046 patent) to circuit ground. The presence of the fine wire forces the hearing aid into a high-gain condition during assembly. The wire is later broken for final testing.

Neither this nor other suggestions (e.g., isolated soundproof assembly booth) have met with acceptance from manufacturers, some of whom have chosen to raise the threshold of compression in order to avoid the manufacturing problem. This, unfortunately, deprives the wearer of the maximum gain he or she needs under quiet conditions.

SUMMARY OF THE INVENTION

An electronic device is set forth that allows external control of a controllable electronic function of the device. The device includes a function circuit for implementing an electronic function in response to a signal at a function control signal input. The function circuit receives DC power from a power supply that is connected between two battery terminals. The DC power from the power supply circuit is supplied at a predetermined DC voltage level. A control circuit is included in the device and is responsive to a signal superimposed on the predetermined DC voltage level of the power supply at the two battery terminals for generating a function control signal at the input of the function circuit.

In accordance with one embodiment of the present invention, the invention is implemented in the context of a hearing aid. The hearing aid includes a microphone for transducing audio waves into electronic signals and a compression amplifier for amplifying the electronic signals. The compression amplifier receives a gain control input signal for adjusting amplifier gain. Power to the compression amplifier is supplied by a power supply. Direct current power is supplied from the power supply at an operational DC voltage level. A gain control circuit is utilized which is responsive to a signal superimposed on the operational DC voltage level of the power supply for generating the gain control input signal to the compression amplifier.

In accordance with one embodiment of the hearing aid, the gain control circuit supplies the gain control input signal at a signal input level which drives the compression amplifier to full gain. The gain control circuit maintains the amplifier at full gain even after the superimposed signal has been removed. This allows a hearing aid assembler to make the necessary adjustments to eliminate feedback, even where the adjustments are made at ambient noise levels that exceed the compression threshold of the compression amplifier.

Other objects and advantages of the present invention will become apparent upon reference to the accompanying detailed description when taken in conjunction with the following drawings.

DETAILED DESCRIPTION OF THE PREFERRED EMBODIMENT

Figure 1:
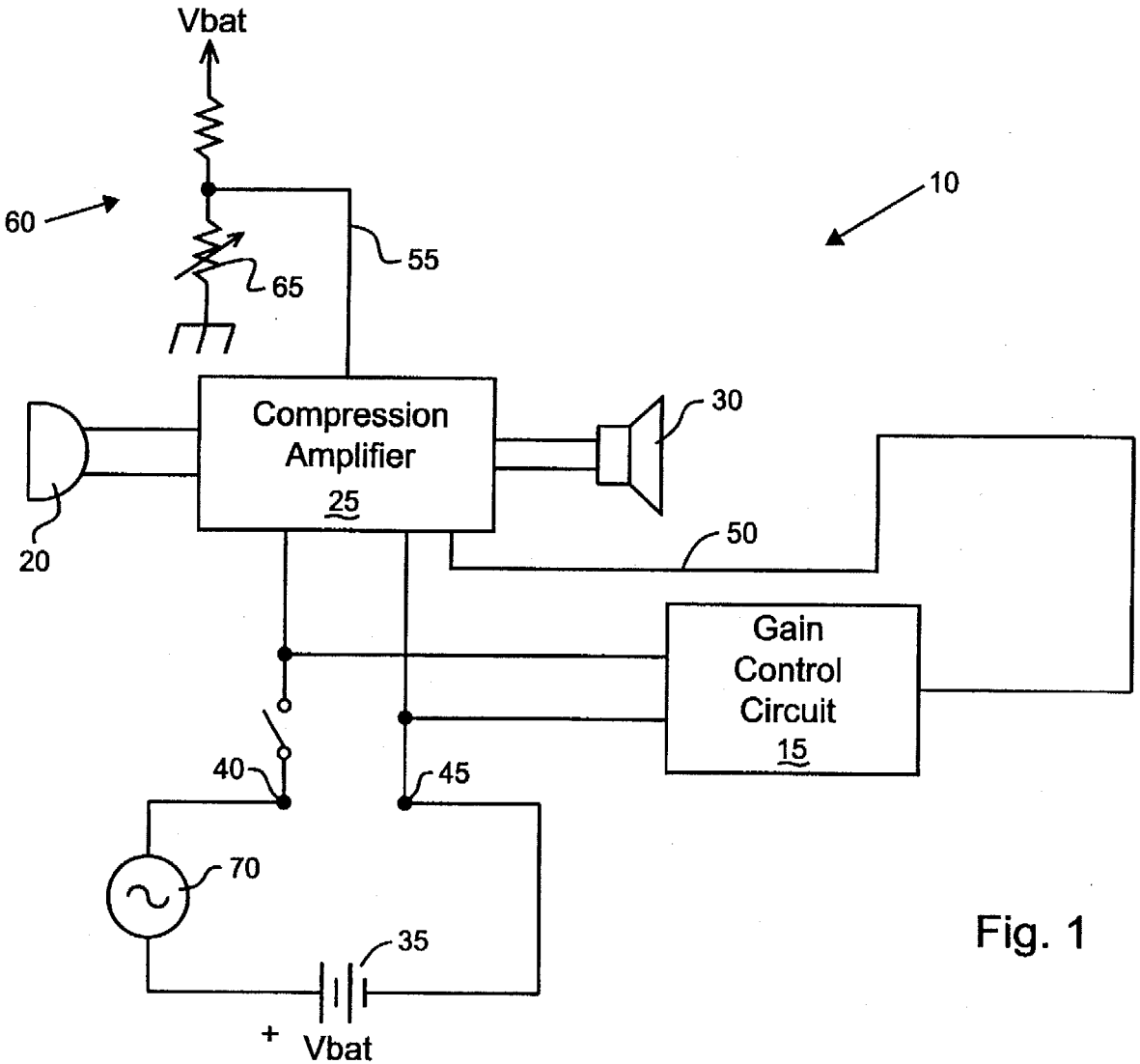
FIG. 1 is a schematic block diagram of a hearing aid employing a gain control circuit that allows external control of the amplifier gain of a compression amplifier utilized in the hearing aid.

FIG. 1 is a schematic block diagram of one embodiment of a hearing aid 10 employing a gain control circuit 15 that is externally controllable. As illustrated, the hearing aid 10 includes a microphone 20, a compression amplifier 25, a receiver 30, a battery 35 and the gain control circuit 15. The microphone 20 operates to transduce sound waves to electrical signals which are subsequently amplified by the compression amplifier 25 which, for example, is constructed in accordance with the teachings of U.S. Pat. No. 4,170,720, previously incorporated by reference. The amplifier output is supplied to the receiver 30 which transduces the electrical signals output from the compression amplifier 25 to sound waves which may be heard by the user. The compression amplifier 25 receives power from the battery 35 which is connected between battery terminals 40 and 45. The battery 35 supplies DC power to the compression amplifier 25 at a predetermined operating voltage level which, for example, may be about 1.5VDC, and range from 1.6VDC to 1.1VDC over the life of the battery. As will be readily recognized by those skilled in the art, the compression amplifier 25 may include various filter and amplification circuitry which tailors the amplification to the particular hearing loss of the user.

The compression amplifier 25 includes a gain control signal input at line 50. The signal at input line 50 sets the gain of the compression amplifier 25 to the desired level during, for example, assembly and/or testing of the hearing aid 10. In the illustrated embodiment, the gain of the amplifier 25 is set dependent on the voltage at line 50. The gain characteristics of the compression amplifier 25 can also be made to be dependent on the voltage level at input line 55. The voltage at line 55 is determined by the voltage divider circuit 60 and is set by adjustment of the resistance of resistor 65 which, for example, may be trim pot. Other circuits for setting the normally operative gain characteristics of the compression amplifier 25 may also be utilized, the illustrative circuit being merely exemplary.

During assembly of the hearing aid 10, the gain of the compression amplifier 25 may be altered through application of an external signal. In the disclosed embodiment, the signal is an AC signal that is supplied by AC supply 70 which is connected to the battery terminals 40 and 45 of the hearing aid 10. In this manner of signal application, there is no need for additional terminals on the hearing aid thus making this implementation very space efficient.

The AC supply 70 provides an AC signal that is superimposed on the DC battery voltage. The resultant combined signal is sensed by gain control circuit 15 which, in turn, supplies a gain control signal at line 50. The level of the gain control signal alters the gain of the compression amplifier 25.

Figure 2:
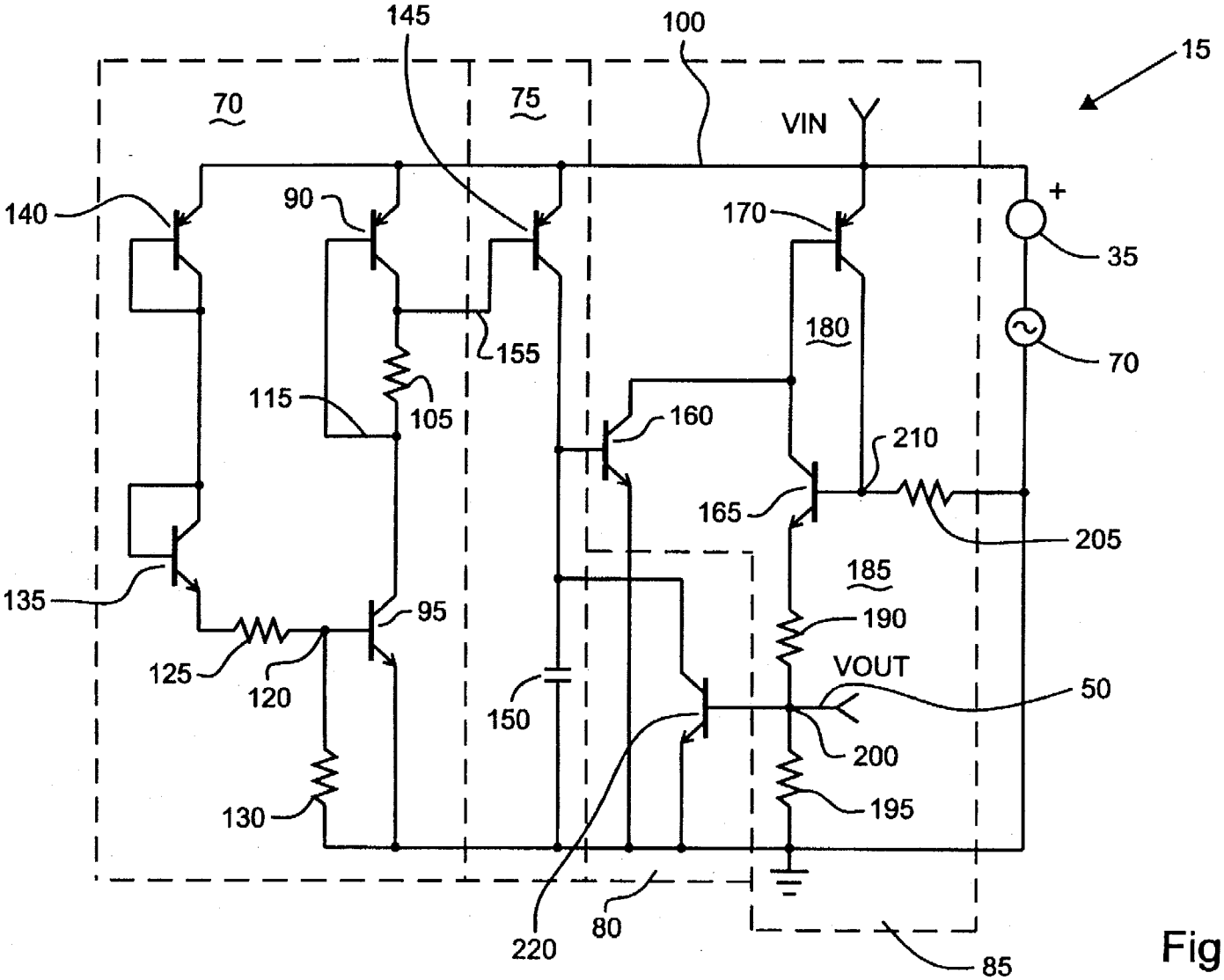
FIG. 2 is a detailed schematic diagram of one circuit implementation of the gain control circuit of FIG. 1.

FIG. 2 is a schematic diagram of one embodiment of the gain control circuit 15 of FIG. 1 which may be readily implemented in an integrated circuit format. The gain control circuit 15 of this particular embodiment can be functionally divided into four functional circuit units: a window detector circuit 70, a charging circuit 75, a discharging circuit 80, and an output circuit 85.

The window detector circuit 70 includes a PNP transistor 90 and an NPN transistor 95. The emitter terminal of the PNP transistor 90 is connected to receive power from the battery supply 35 along power bus 100. The collector terminal of the PNP transistor 90 is connected to a first terminal of resistor 105. The base of the PNP transistor 90 is connected to the second terminal of resistor 105 at mode 115. The NPN transistor 95 includes a collector that is connected to mode 115 and an emitter that is connected to ground. The base of the NPN transistor 95 is connected to junction 120 which is the center junction of a voltage divider formed by resistors 125 and 130. The voltage divider circuit receives power from the power bus 100 through a further NPN transistor 135 and PNP transistor 140 which are series connected as diodes between the power bus 100 and a terminal of resistor 125.

The charging circuit 75 includes a PNP transistor 145 and a charging capacitor 150. The emitter of the PNP transistor 145 is connected to the power bus 100 and the collector of the PNP transistor 145 is connected to the charging capacitor 150 which, in turn, extends between the collector and ground. The base of the PNP transistor 145 is connected to receive the signal output from the window detector 70 along line 155.

The output circuit 85 includes NPN transistors 160 and 165 and PNP transistor 170. NPN transistor 165 and PNP transistor 170 are connected to one another in an SCR switching configuration 180 which is actuated by the signal at the collector of NPN transistor 160. The SCR switch 180 is connected between the power bus 100 and a voltage divider 185 including resistors 190 and 195 which are joined at junction 200. A resistor 205 extends between ground and the junction 210 formed by the base of NPN transistor 165 and the collector of PNP transistor 170. The output control signal to the input of the compression amplifier 25 is supplied along line 50 from junction 200.

The discharge circuit 80 includes NPN transistor 220 which has its emitter and collector connected across the charging capacitor 150. The NPN transistor 220 is actuated by the signal at junction 200 which is supplied to its base terminal.

Under normal hearing aid operation, the battery voltage, for example, 1.3 VDC is supplied to the power bus 100. At this operational voltage, NPN transistor 95 is in an off state as are the other transistors of the gain control circuit 15. The gain control signal at line 50 is thus unaffected by the gain control circuit 15 except to the extent that resistor 195 is in parallel with any resistor external to the gain control circuit 15. The compression amplifier 25 is set to a user specified gain by varying the resistance of resistor 65 to a gain level that is tailored for the particular hearing aid wearer.

During assembly of the hearing aid 10, it is desirable to set the gain of the compression amplifier 25 to full on. To accomplish this, a control signal is superimposed on the DC battery power on the power bus 100. This may be done, for example, by connecting the AC generator 70 across the battery terminals 40 and 45 as illustrated in FIG. 1. The voltage amplitude of the AC signal is set so that the positive peaks of the resultant signal fall between an upper and lower threshold level or window of the window detector 70.

When the voltage on the power bus 100 exceeds the lower window threshold level of the window detector circuit 70 but is less than the upper threshold level, NPN transistor 95 goes to an on state which, in turn, drives PNP transistor 90 on as well. The signal on line 155 is thus active thereby causing PNP transistor 145 to go to an on state resulting in charging of the charge capacitor 150. When the voltage on the power bus exceeds the upper threshold level of the window detector 70, the voltage drop across resistor 105 increases to a level which causes the signal on line 155 to go to an inactive state thereby driving PNP transistor 145 to an off state and inhibiting further charging of the charge capacitor 150.

With the signal on the power bus 100 within the window of the window detector 70 for a period of time, the charge capacitor 150 is ultimately charged to a level which drives NPN transistor 160 to an on state. With NPN transistor 160 in an on state, the SCR switch 180 is activated thereby through-connecting the signal on the power bus 100 to the voltage divider 185. This results in an increase in the voltage of the gain control signal at line 50 thereby increasing the gain of the compression amplifier 25. Preferably, the voltage of the gain control signal rises to a level which increases the gain of the compression amplifier 25 to a full on level.

When the voltage at line 50 goes to an active state, NPN transistor 220 is driven to an on state. The NPN transistor 220 thereby provides a current path therethrough to discharge the capacitor 150. The SCR switch 180 remains closed even after the voltage on the power bus 100 returns to the normal operating voltage level. The hearing aid assembler may then make the necessary physical adjustments to the hearing aid receiver to reduce or eliminate the potential for oscillatory feedback. When the adjustments are complete, the assembler need only remove power from the power bus 100 by, for example, turning switch 230 (FIG. 1) off. The gain control circuit 15 will then remain inactive until a control signal in the window of the window detector 70 is again presented on the power bus 100 for a period of time sufficient to charge capacitor 150.

In the exemplary embodiment illustrated in FIG. 2, the various components may have the following values:

TABLE 1

| COMPONENT NUMBER | VALUE |
|---|---|
| 105 | 125K Ω |
| 125 | 20K Ω |
| 130 | 80K Ω |
| 150 | 300 pf |
| 190 | 12K Ω |
| 195 | 60K Ω |
| 205 | 12K Ω |

With the foregoing component values, the lower threshold level of the window detector 70 will be approximately 1.75 V while the upper threshold value will be approximately 1.9 V. The lower threshold value is greater than the maximum operating battery voltage expected on the bus 100.

Figure 3:
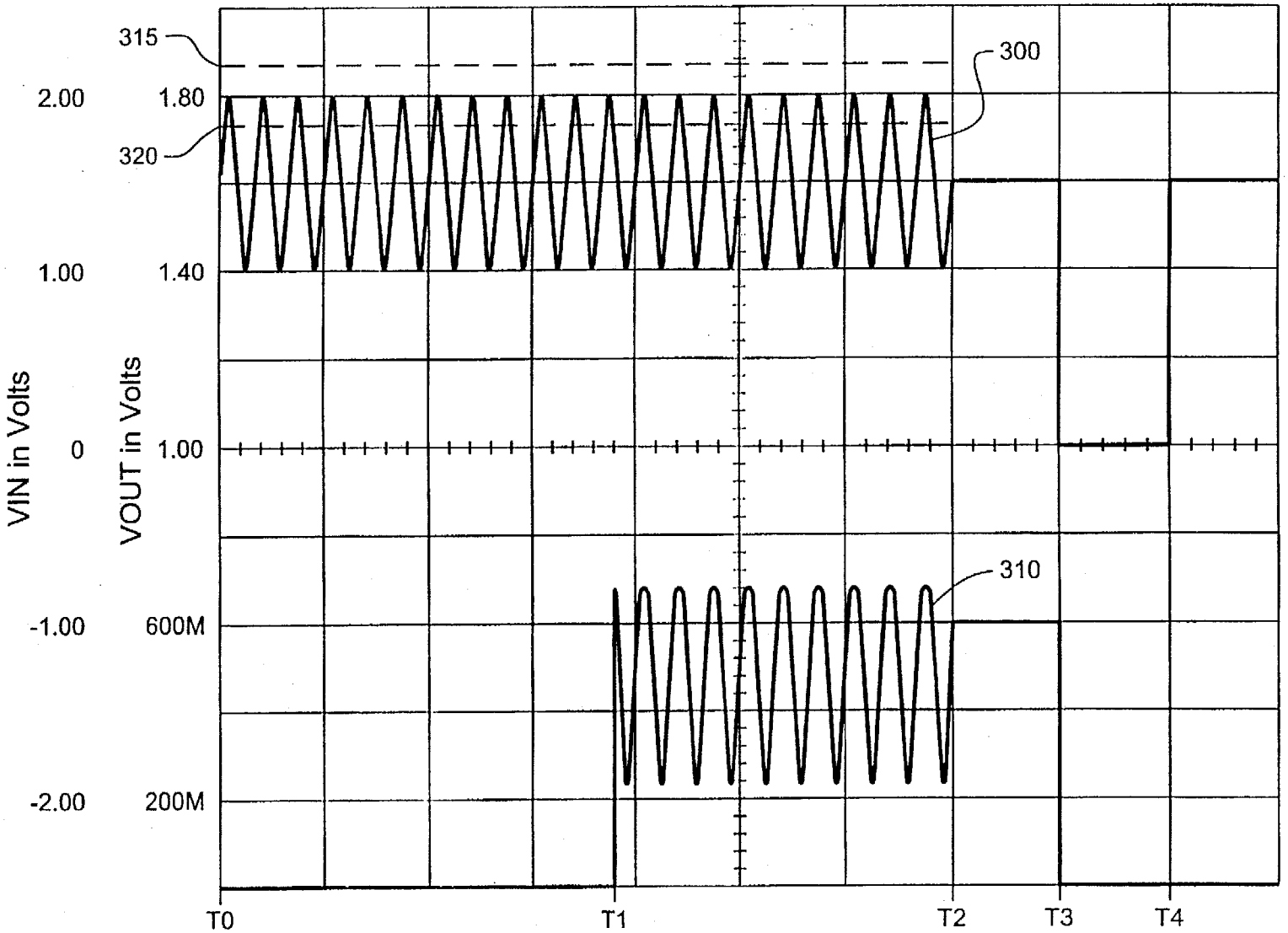
FIG. 3 is a signal diagram showing a control signal superimposed on the DC battery supply signal as well as the resultant output voltage from the gain control circuit.

FIG. 3 is a signal diagram illustrating the signal on the power bus 100, shown here at line 300, and the resulting gain control signal, shown here at line 310. Between time T0 and T2, the signal 300 is a DC signal with an AC signal superimposed thereon. The positive peaks of the signal 300 fall within the window of the window detector 70, the window being shown here between lines 315 and 320. During each positive peak, the capacitor 150 is charged until time T1, at which point it has risen to a voltage level which leads to the activation of the SCR switch 180. The gain control signal 310 generally tracks the signal on the power bus 100. As a result, the gain control signal 310 includes an AC component until that component is removed at time T2. The gain control signal remains a DC signal after time T2 until power is removed from the power bus 100 at time T3. At that point, both the gain control signal 310 and the signal 300 on power bus 100 fall to zero. At time T4, power is again supplied to the power bus 100 but the gain control signal 310 remains inactive.

Figure 4:
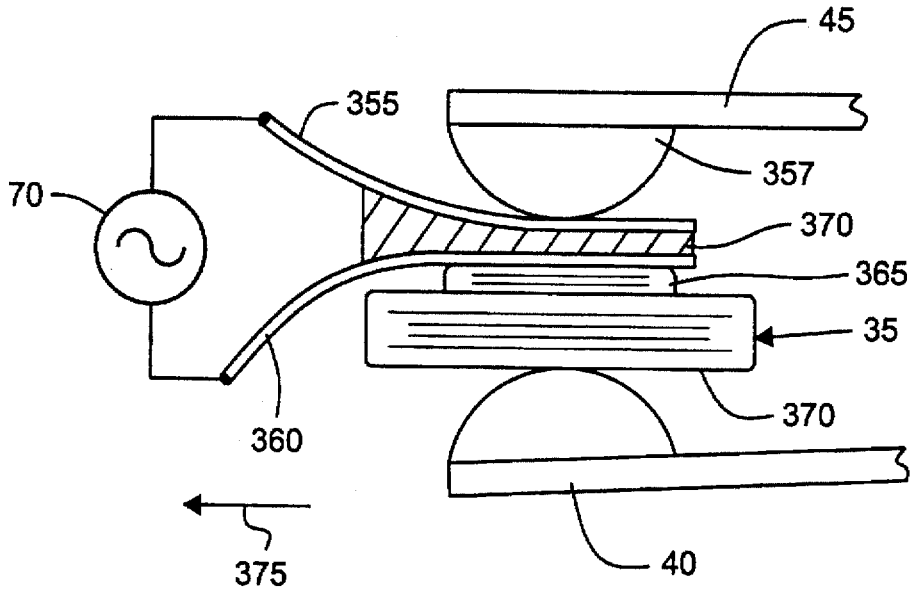
FIGS. 4 and 5 illustrate a mechanical device which may be used to attach and remove the superimposed signal for activating the gain control circuit.
Figure 5:
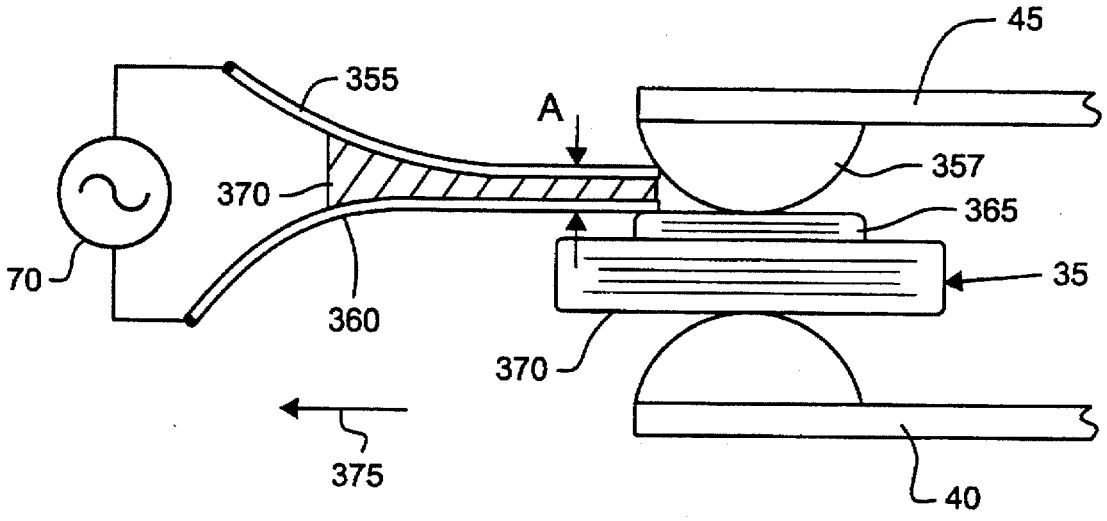

FIGS. 4 and 5 illustrate a mechanical device, shown generally at 350, which may be used to attach and remove the superimposed signal. The device 350 includes a first electrically conducting member 355 that contacts battery terminal 45 at an arcuate portion 357 thereof and a second electrically conducting member 360 that contacts a first electrode 365 of battery 35. The battery 35 further includes a second electrode 370 that contacts battery terminal 40. The first and second members 355 and 360 are separated from one another by a dielectric material 370 and are connected to respective terminals of the AC supply 70. The device 350 thus places the AC supply 70 in series with the battery 35 for supplying the superimposed signal to the gain control circuit 15.

The device 350 further assists in allowing removal of the superimposed signal without allowing the SCR switch 180 to go to an off condition. As previously noted, the SCR switch 180 will go to an off condition if the DC power from the battery supply is removed. The device 350 allows removal of the superimposed signal without disconnection of the DC power from the battery 35. This is done by extracting the device 350 in the direction of arrow 375. As the device 350 is extracted, the arcuate portion 357 of the battery terminal 45 is driven toward electrode 365 under the spring action of lever arm portion 380 of the terminal 45. The height A of the device 350 is chosen so that the first and second members 355 and 360 are in constant contact with the arcuate portion 357 and electrode 365 until such time as the arcuate portion 357 is in electrical contact with the electrode 365, as shown in FIG. 5.

Although the present invention has been described with reference to a specific embodiment, those of skill in the art will recognize that changes may be made thereto without departing from the scope and spirit of the invention as set forth in the appended claims.

What is claimed is:

1. An electronic device comprising:

a) a function circuit for implementing an electronic function in response to a function control signal;

b) a power supply for supplying DC power to the function circuit, the DC power being supplied from the power supply at an operational DC voltage level at first and second battery terminals; and c) control means, responsive to a signal superimposed on the operational DC voltage level of the power supply at the first and second battery terminals, for generating the function control signal to the function circuit, the control means comprising, a window detector circuit connected to the power supply and responsive to generate an active output signal only in a predetermined window of voltage levels of the superimposed signal;

a charging circuit including a charging capacitor, the active output signal of the window detector causing charging of the charging capacitor, the charging circuit generating a switch signal when the charging capacitor is charged to a predetermined charging voltage level; and an output circuit, including an SCR switch that is responsive to the switch signal, for generating the function control input signal when the SCR switch is switched to an on state.

2. An electronic device as claimed in claim 1 wherein the function circuit is an amplifier, the function control signal generated by the control means controlling amplifier gain of the amplifier.

3. An electronic device as claimed in claim 1 wherein the control means is responsive to an AC voltage superimposed on the operational DC voltage level.

4. An electronic device as claimed in claim 1 wherein the predetermined window has a lower threshold voltage level and an upper voltage threshold level, the lower threshold voltage level being at a voltage level that is greater than the voltage level of the operational DC voltage level.

5. An electronic device as claimed in claim 1 and further comprising discharge means for discharging the charging capacitor once the SCR switch is switched to the on state.

6. A hearing aid comprising:

a) a microphone for transducing audio waves into electronic signals;

b) a compression amplifier for amplifying the electronic signals, the compression amplifier being responsive to a gain control signal for adjusting amplifier gain;

c) a receiver for transducing the amplified electronic signals to sound waves;

d) a power supply for supplying DC power to the compression amplifier, the DC power being supplied from the power supply at an operational DC voltage level; and e) gain control means, responsive to a signal superimposed on the operational DC voltage level of the power supply, for generating the gain control signal to the compression amplifier.

7. A hearing aid as claimed in claim 6 wherein the gain control means is responsive to an AC voltage superimposed on the operational DC voltage level.

8. A hearing aid as claimed in claim 6 wherein the gain control means supplies the gain control signal at a level which drives the amplifier to full gain.

9. A hearing aid as claimed in claim 6 wherein the gain control means maintains the compression amplifier at full gain after removal of the superimposed signal.

10. A hearing aid as claimed in claim 6 and further comprising further means for setting the amplifier gain to a user determined gain level less than full gain.

11. A hearing aid as claimed in claim 6 and further comprising restoring means for restoring the user determined gain level.

12. A hearing aid as claimed in claim 6 wherein the gain control means comprises:

a) a window detector circuit connected to the power supply and responsive to generate an active output signal only in a predetermined window of voltage levels of the superimposed signal;

b) a charging circuit including a charging capacitor, the active output signal of the window detector causing charging of the charging capacitor, the charging circuit generating a switch signal when the charging capacitor is charged to a predetermined charging voltage level; and c) an output circuit, including an SCR switch that is responsive to the switch signal, for generating the gain control signal when the SCR switch is switched to an on state.

13. A hearing aid as claimed in claim 12 wherein the predetermined window has a lower threshold voltage level and an upper voltage threshold level, the lower threshold voltage level being at a voltage level that is greater than the voltage level of the predetermined DC voltage level.

14. A hearing aid as claimed in claim 12 and further comprising discharge means for discharging the charging capacitor when the SCR switch is switched to the on state.

15. A gain control circuit for use in a hearing aid wherein the hearing aid includes a source of DC power connected between first and second battery terminals for supplying DC power to the hearing aid circuits at an operational DC voltage level, the hearing aid further including a compression amplifier responsive to a gain control signal, the gain control circuit comprising:

a) a window detector circuit responsive to a control signal superimposed on the operational DC voltage level of the source of DC power at the first and second battery terminals to generate an active output signal only in a predetermined window of voltage levels of the superimposed signal;

b) a charging circuit including a charging capacitor, the active output signal of the window detector causing charging of the charging capacitor, the charging circuit generating an active switch signal when the charging capacitor is charged to a predetermined charging voltage level; and c) an output circuit, including an SCR switch that is responsive to the active switch signal, for generating the gain control signal when the SCR switch is switched to an on state.

16. A gain control circuit as claimed in claim 15 wherein the superimposed signal is an AC voltage.

17. A gain control circuit as claimed in claim 15 wherein the gain control signal to the compression amplifier is at a signal input level which drives the compression amplifier to full gain.

18. A gain control circuit as claimed in claim 17 wherein the gain control signal from the output circuit maintains the compression amplifier at full gain after removal of the superimposed signal.

19. A gain control circuit as claimed in claim 15 wherein the predetermined window has a lower threshold voltage level and an upper voltage threshold level, the lower threshold level being at a level that is greater than the level of the operational DC voltage level.

20. A gain control circuit as claimed in claim 15 and further comprising discharge means for discharging the charging capacitor when the SCR switch is switched to the on state.

21. A method for adjusting feedback sensitive components of a hearing aid comprising the steps of:

a) supplying an operational DC power signal to the hearing aid;

b) superimposing a control signal on the DC power signal;

c) sensing the control signal using a gain control circuit disposed in the hearing aid;

d) using the gain control circuit to increase gain of a compression amplifier of the hearing aid to full gain upon sensing of the control signal; and e) physically adjusting the feedback sensitive components of the hearing aid with the amplifier at full gain.

22. A method as claimed in claim 21 wherein the control signal is an AC signal.

23. A method as claimed in claim 21 wherein the gain control circuit is only responsive to a gain control signal having a level within a predetermined window.

24. A method as claimed in claim 23 wherein the predetermined window has an upper threshold level and a lower threshold level, the lower threshold level being greater than the operational DC power signal.

25. A method as claimed in claim 21 wherein the physically adjusting step comprises the step of adjusting the position of a receiver component of the hearing aid.

* * * * *